US009843112B2

(12) United States Patent
Zhu et al.

(10) Patent No.: US 9,843,112 B2
(45) Date of Patent: Dec. 12, 2017

(54) CONNECTOR INCLUDING A PLURALITY OF WIRES TO TRANSFER DATA

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Zhi-Ming Zhu, Wuhan (CN); Ting Wang, Wuhan (CN); Ming-Hui Luo, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 62 days.

(21) Appl. No.: 14/683,976

(22) Filed: Apr. 10, 2015

(65) Prior Publication Data

US 2016/0233628 A1 Aug. 11, 2016

(30) Foreign Application Priority Data

Feb. 9, 2015 (CN) ..... 2015 1 0065887

(51) Int. Cl.

| | |
|---|---|
| ***H01R 4/02*** | (2006.01) |
| ***H01R 9/03*** | (2006.01) |
| ***H01R 13/04*** | (2006.01) |
| ***H01R 13/629*** | (2006.01) |
| *H01R 107/00* | (2006.01) |
| *H01R 24/58* | (2011.01) |
| *H01R 13/514* | (2006.01) |
| *H01R 4/70* | (2006.01) |
| *H01R 9/24* | (2006.01) |
| *H01R 13/502* | (2006.01) |

(52) U.S. Cl.

CPC ..... *H01R 4/029* (2013.01); *H01R 9/03* (2013.01); *H01R 13/04* (2013.01); *H01R 13/629* (2013.01); *H01R 4/70* (2013.01); *H01R 9/2491* (2013.01); *H01R 13/502* (2013.01); *H01R 13/514* (2013.01); *H01R 24/58* (2013.01); *H01R 2107/00* (2013.01)

(58) Field of Classification Search

CPC ..... H01R 13/514; H01R 24/58; H01R 4/70; H01R 9/2491

See application file for complete search history.

(56) References Cited

U.S. PATENT DOCUMENTS

2008/0214042 A1* 9/2008 Kondo ..... H01R 4/027 439/466

2010/0068939 A1* 3/2010 Xu ..... H01R 24/60 439/651

* cited by examiner

*Primary Examiner* — Abdullah Riyami
*Assistant Examiner* — Justin Kratt
(74) *Attorney, Agent, or Firm* — Steven Reiss

(57) ABSTRACT

A connector includes a plug, a plurality of wires, and a clamping member. The clamping member defines a plurality of slots. The plug includes a plurality of pins. Each wire is engaged with one of the plurality of pins and is clamped in one of plurality of slots. The plurality of wires is substantially parallel to each other near the clamping member. A manufacturing method for the connector is also provided.

6 Claims, 5 Drawing Sheets

CONNECTOR INCLUDING A PLURALITY OF WIRES TO TRANSFER DATA

CROSS-REFERENCE TO RELATED APPLICATIONS

This application claims priority to Chinese Patent Application No. 201510065887.7 filed on Feb. 9, 2015, the contents of which are incorporated by reference herein.

FIELD

The subject matter herein generally relates to a connector and a manufacturing method for the connector.

BACKGROUND

A connector is used for transmitting data between two electronic devices. The connector includes a plurality of wires to transfer the data.

BRIEF DESCRIPTION OF THE DRAWINGS

Implementations of the present technology will now be described, by way of example only, with reference to the attached figures.

DETAILED DESCRIPTION

Figure 1:
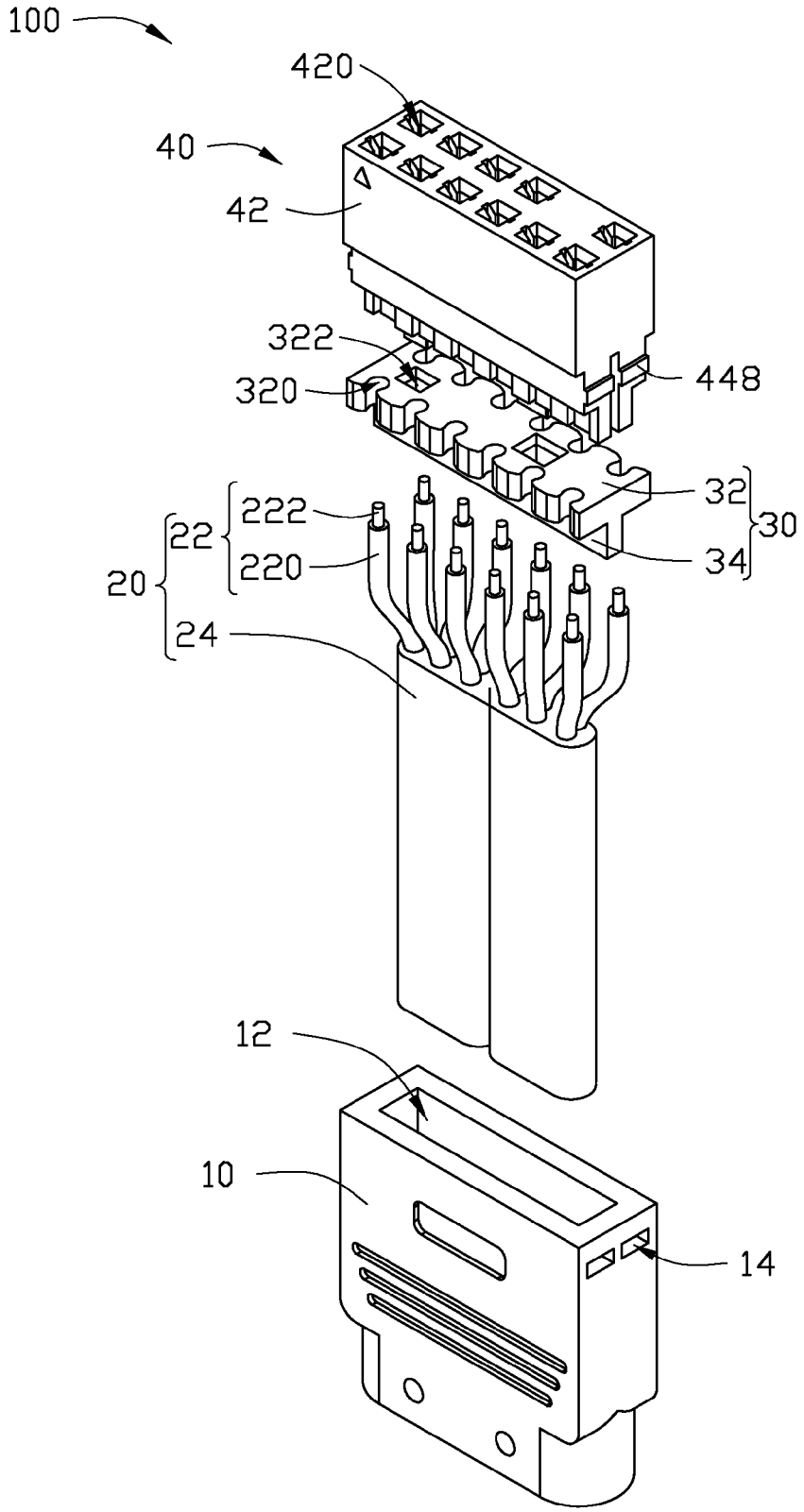
FIG. 1 is an exploded, isometric view of one embodiment of a connector.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

The present disclosure is described in relation to a connector

Figure 2:
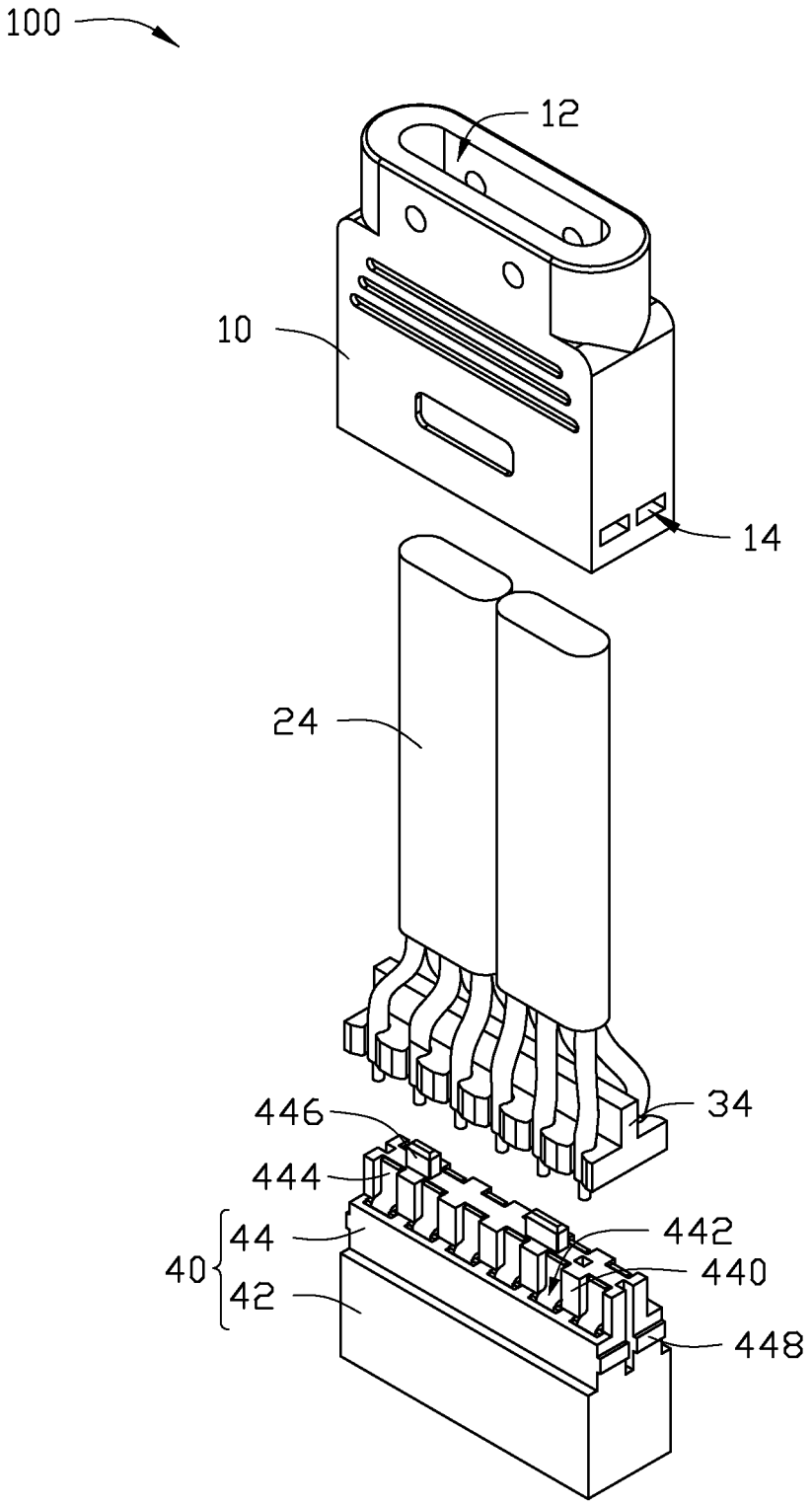
FIG. 2 is similar to FIG. 1, but viewed from another angle.

FIGS. 1-2 illustrate one embodiment of a connector 100. The connector 100 includes a shell 10, two cables 20, a clamping member 30, and a plug 40.

A receiving space 12 is defined through the shell 10. Two fixing holes 14 are defined in opposite sides of the shell 10 and communicate with the receiving space 12. In one embodiment, the shell 10 can be integrally formed by injection molding.

Each cable 20 includes a plurality of wires 22 and a jacket 24. The plurality of wires 22 is packaged by the jacket 24, and a part of each of the plurality of wires 22 extends out of the jacket 24. Each wire 22 includes insulation 220 and a conductor 222. The insulation 220 jackets the conductor 222. The conductor 222 is packaged by the insulation 220, and a part of the conductor 222 extends out of the insulation 220. In one embodiment, the jacket 24 can be made of insulation material.

The clamping member 30 includes a first plate 32 and a second plate 34 extending from the first plate 32. In an embodiment, the second plate 32 is substantially perpendicular to the first plate 32. The first plate 32 defines a plurality of slots 320 and two latching holes 322. The plurality of slots 320 is evenly spaced from each other and is aligned in two rows. Two latching holes 322 are defined between the two rows of the plurality of slots 320.

The plug 40 includes a main portion 42 and an extending portion 44. The extending portion 44 extends from the main portion 42. The main portion 42 defines a plurality of inserting holes 420. The extending portion 44 includes a plurality of protruding portions 440, a plurality of pins 444, two connecting structures 446, and four fixing members 448. The plurality of protruding portions 440 is evenly spaced from each other and is aligned in two rows. A groove 442 is defined between each two adjacent protruding portions 440. Each pin 444 is located in one groove 442. Two connecting structures 446 are located between the two rows of the plurality of protruding portions 440.

Figure 3:
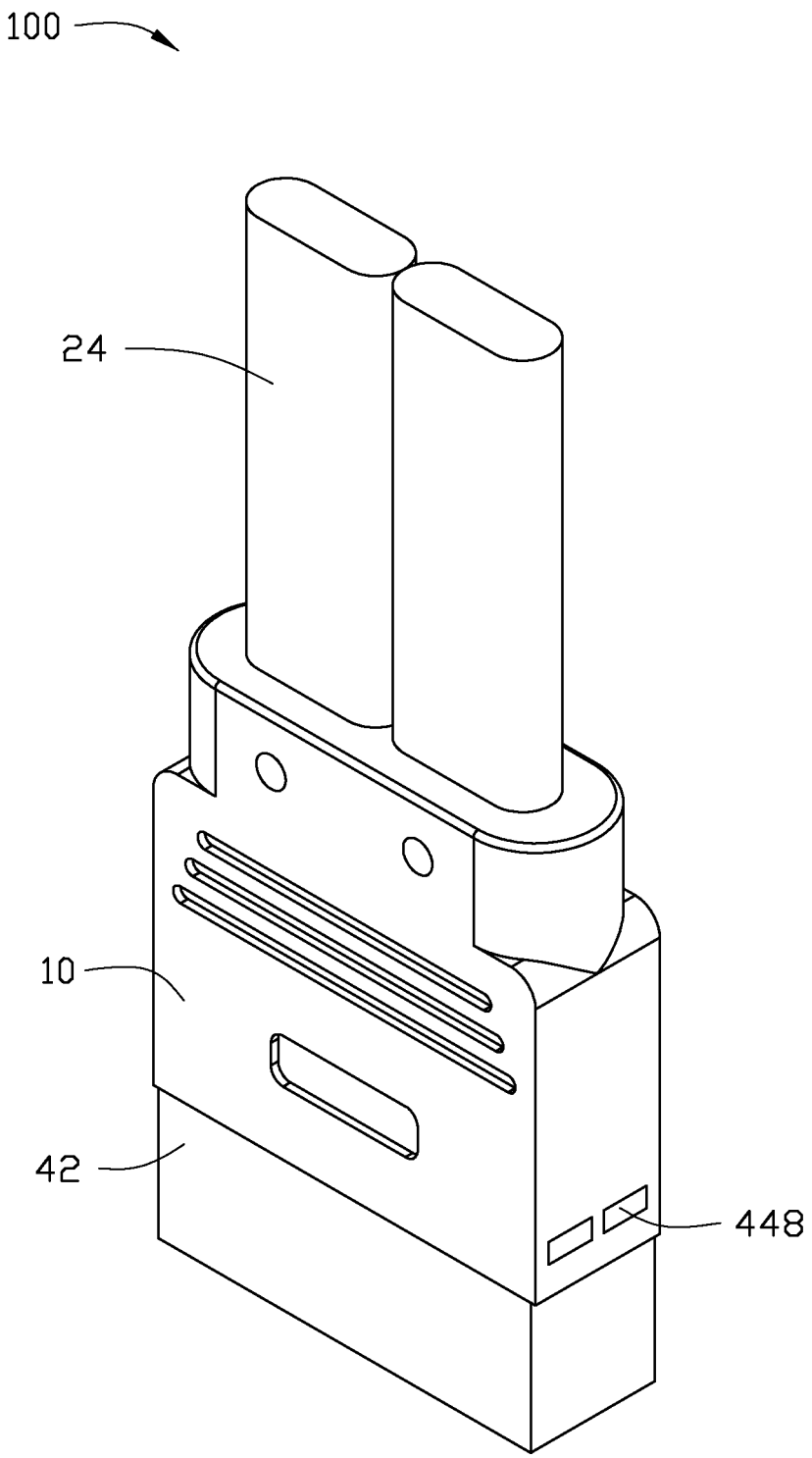
FIG. 3 is an assembled, isometric view of the connector of FIG. 1.
Figure 4:
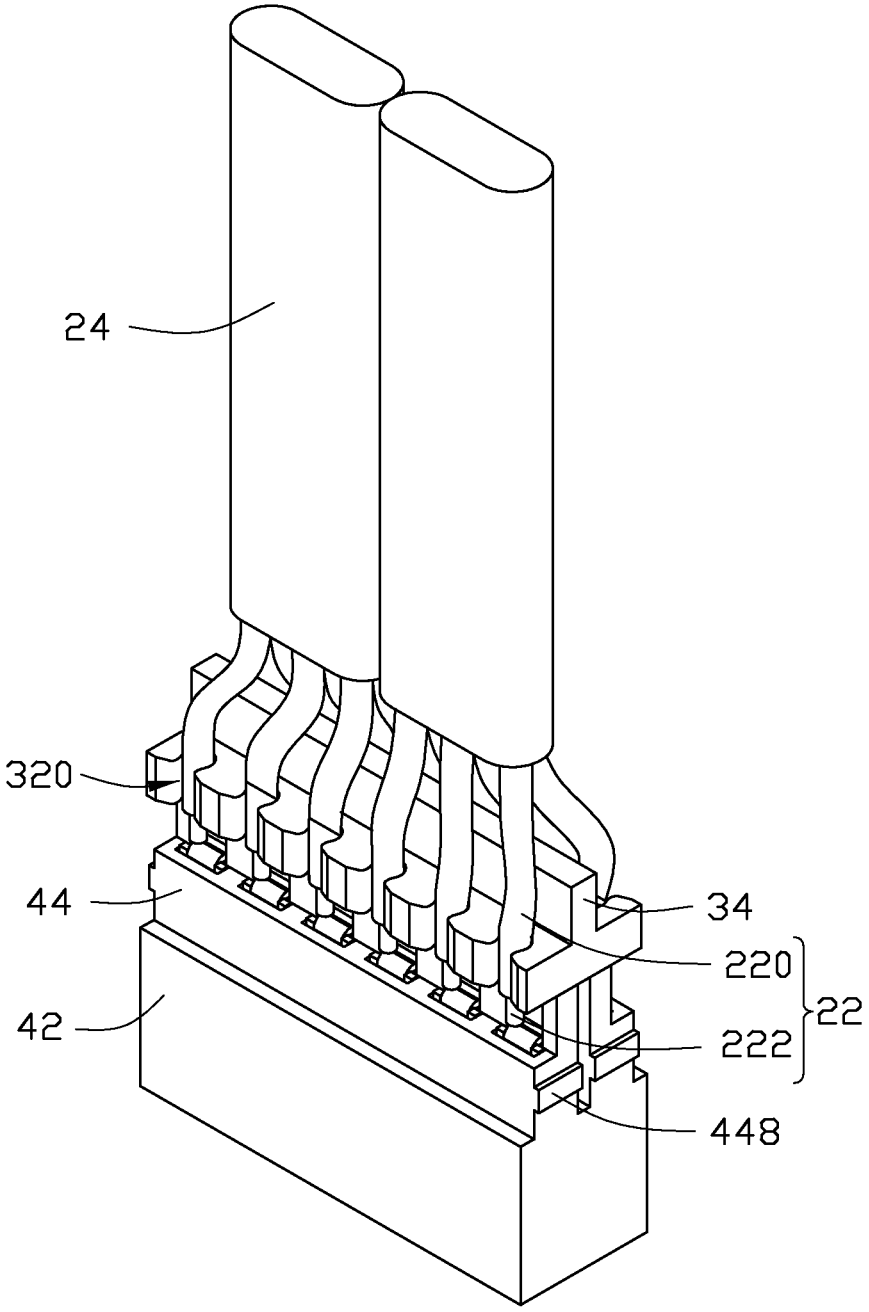
FIG. 4 is an isometric view of the connector's internal structure of FIG. 3.

FIGS. 3-4 illustrate assembled views of the connector of FIG. 1. When the connector 100 is assembled, two connecting structures 446 are engaged with the two latching holes 322 to fix the clamping member 30 with the plug 40. The plurality of wires 22 is clamped with the plurality of slots 320. The plurality of conductors 222 extending out of the insulation 220 is electronically connected with the plurality of pins 444. In an embodiment, the conductors 222 are connected with the pins 444 with a weld. Parts of the plurality of wires 22 fixed with the plug 40 are substantially parallel to each other. The plug 40, the clamping member 30, and two cables 20 can be molded together. The extending portion 44, the clamping member 30, and two cables 20 are received in the receiving space 12. The four fixing members 448 of the plug 40 are engaged in the four fixing holes 14 of the shell 10.

Figure 5:
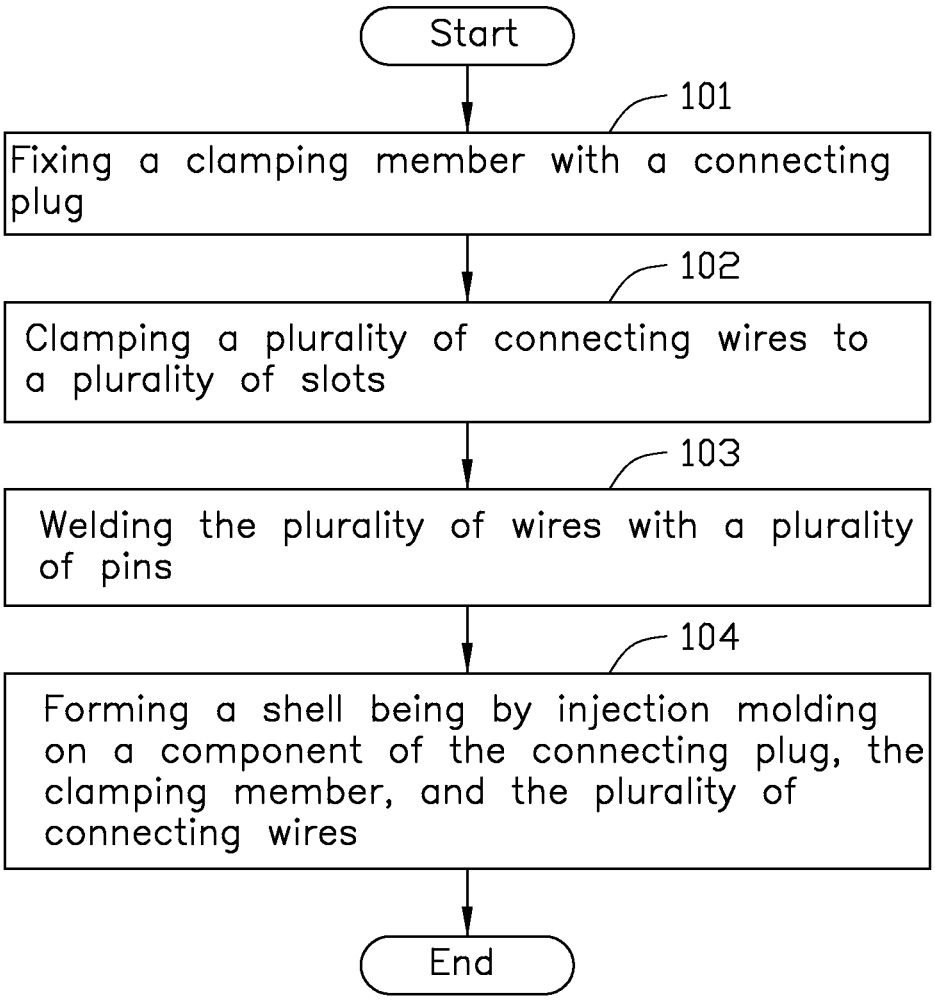
FIG. 5 is a flowchart of one embodiment of a manufacturing method for the connector of FIG. 1.

FIG. 5 illustrates a flowchart in accordance with an example embodiment. A detection step of a manufacturing method for the connector 100 is provided by way of example, as there are a variety of ways to carry out the method. The manufacturing method for the connector 100 described below can be carried out using the configurations illustrated in FIGS. 1-4, for example, and various elements of these figures are referenced in explaining manufacturing method for the connector 100. Each block shown in FIG. 5 represents one or more processes, methods, or subroutines carried out in the indicator light detection method. Furthermore, the illustrated order of blocks is by example only and the order of the blocks can change. Additional blocks may be added or fewer blocks may be utilized, without departing from this disclosure. The manufacturing method for the connector 100 can begin at block 101.

At block 101, the clamping member 30 is fixed with the plug 40.

At block 102, the plurality of wires 22 is clamped in the plurality of slots 320, and parts of the plurality of wires 22 clamped in the plurality of slots 320 are substantially parallel to each other.

At block 103, the plurality of wires 22 is electronically connected with the plurality of pins 444.

At block 104, the shell 10 is formed by injection molding to the plug 40, the clamping member 30, and the plurality of wires 22.

The embodiments shown and described above are only examples. Many details are often found in the art such as the other features of a connector. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A connector comprising:

a plug comprising an extending portion, the extending portion comprising a plurality of pins and two connecting structures;

a plurality of wires; and a clamping member defining a plurality of slots;

wherein the clamping member is engaged with the plug, the plurality of wires is electrically connected with the plurality of pins and is clamped within the plurality of slots, and the plurality of wires is substantially parallel to each other near the clamping member, each wire comprises a conductor, and each conductor is engaged with one of the pins; the clamping member defines two latching holes and the two connecting structures comprised in the extending portion are engaged with the two latching holes to fix the clamping member to the plug.

2. The connector of claim 1, wherein the extending portion comprises a plurality of protruding portions, and one groove is formed between two of the plurality of protruding portions.

3. The connector of claim 2, wherein each pin is located in the groove.

4. The connector of claim 2, wherein the plurality of protruding portions is evenly spaced from each other and is aligned in two rows.

5. The connector of claim 1, further comprising a shell, wherein the shell defines four fixing holes, the extending portion comprises four fixing members, and four fixing members are engaged with four fixing holes to fix the plug to the shell.

6. A connector comprising:

a plug having a main portion and an extending portion, a plurality of inserting holes being defined in the main portion;

a plurality of pins extending from the extending portion into the plurality of inserting holes;

a plurality of wires; and a clamping member engagable with the extending portion of the plug, a plurality of slots being defined along a peripheral edge of the clamping member;

wherein, each of the plurality of wires is inserted into one of the plurality of defined slots in the clamping member and central axes of all of the plurality of wires are substantially parallel when the clamping member is engaged with the extending portion of the plug;

wherein, each of the plurality of inserting holes is coupled to one of the plurality of pins; and wherein, each of the plurality of pins is electrically connected to one of the plurality of wires when the clamping member is engaged with the plug.

* * * * *